US012649600B2

(12) United States Patent
Rothwell

(10) Patent No.: US 12,649,600 B2
(45) Date of Patent: Jun. 9, 2026

(54) APPARATUS FOR CONDITIONING REFILLABLE ARTICLES FOR AEROSOL PROVISION SYSTEMS

(71) Applicant: NICOVENTURES TRADING LIMITED, London (GB)

(72) Inventor: Howard Rothwell, London (GB)

(73) Assignee: NICOVENTURES TRADING LIMITED, London (GB)

( * ) Notice: Subject to any disclaimer, the term of this patent is extended or adjusted under 35 U.S.C. 154(b) by 0 days.

(21) Appl. No.: 18/844,453

(22) PCT Filed: Mar. 6, 2023

(86) PCT No.: PCT/GB2023/050520
§ 371 (c)(1),
(2) Date: Sep. 6, 2024

(87) PCT Pub. No.: WO2023/170391
PCT Pub. Date: Sep. 14, 2023

(65) Prior Publication Data

US 2025/0206478 A1 Jun. 26, 2025

(30) Foreign Application Priority Data

Mar. 7, 2022 (GB) ..... 2203110

(51) Int. Cl.
*B65B 31/00* (2006.01)

(52) U.S. Cl.
CPC ..... *B65B 31/003* (2013.01)

(58) Field of Classification Search
CPC ..... B65B 31/003; B65B 3/26; B65B 29/00; A24F 15/015
See application file for complete search history.

(56) References Cited

U.S. PATENT DOCUMENTS

2011/0094523 A1 4/2011 Thorens
2012/0167906 A1* 7/2012 Gysland ..... A24F 40/00 131/328

(Continued)

FOREIGN PATENT DOCUMENTS

GB 2542008 A 3/2017
WO 2020208355 10/2020

(Continued)

OTHER PUBLICATIONS

PCT International Search Report and Written Opinion in International Appln. No. PCT/GB2023/050520, dated Aug. 7, 2023, 19 pages.

*Primary Examiner* — Jason K Niesz
(74) *Attorney, Agent, or Firm* — MERCHANT & GOULD P.C.

(57) ABSTRACT

A refilling device for filling an article from a reservoir includes an article interface for receiving an article of an aerosol provision system, the article having a storage area for fluid and an atomizer having porosity for absorbing fluid from the storage area and having an electrically conductive heating member for vaporizing the absorbed fluid; and a controller configured to supply electrical power to produce electrical current flow in the heating member of an article received in the article interface during a heating period to cause heating of the heating member; and execute a filling action to deliver fluid to the storage area of the article after the heating period.

21 Claims, 5 Drawing Sheets

(56) References Cited

U.S. PATENT DOCUMENTS

| | | | | |
|---|---|---|---|---|
| 2015/0313283 | A1 | 11/2015 | Collett | |
| 2016/0200463 | A1 | 7/2016 | Hodges et al. | |
| 2017/0086502 | A1 | 3/2017 | Hearn et al. | |
| 2017/0208863 | A1* | 7/2017 | Davis | A24F 40/485 |
| 2017/0265523 | A1 | 9/2017 | Lipowicz | |
| 2017/0333650 | A1 | 11/2017 | Buchberger et al. | |
| 2017/0360116 | A1 | 12/2017 | Memari et al. | |
| 2018/0286208 | A1 | 10/2018 | Baker | |
| 2020/0383378 | A1 | 12/2020 | Moloney et al. | |
| 2021/0337878 | A1* | 11/2021 | Gretton | A24F 40/44 |

FOREIGN PATENT DOCUMENTS

| | | | |
|---|---|---|---|
| WO | 2021140307 | A1 | 7/2021 |
| WO | 2021245272 | A1 | 12/2021 |
| WO | 2022084649 | A1 | 4/2022 |

* cited by examiner

APPARATUS FOR CONDITIONING REFILLABLE ARTICLES FOR AEROSOL PROVISION SYSTEMS

RELATED APPLICATIONS

The present application is a National Phase entry of PCT Application No. PCT/GB2023/050520 filed Mar. 6, 2023, which claims priority to GB Application No. 2203110.8 filed Mar. 7, 2022, each of which is hereby incorporated by reference in their entirety.

TECHNICAL FIELD

The present disclosure relates to devices configured to condition refillable articles for electronic aerosol provision systems.

BACKGROUND

Electronic aerosol provision systems, which are often configured as so-called electronic cigarettes, can have a unitary format with all elements of the system in a common housing, or a multi-component format in which elements are distributed between two or more housings which can be coupled together to form the system. A common example of the latter format is a two-component system comprising a device and an article. The device typically contains an electrical power source for the system, such as a battery, and control electronics for operating elements in order to generate aerosol. The article, also referred to by terms including cartridge, cartomizer, consumable and clearomizer, typically contains a storage volume or area for holding a supply of aerosolizable material from which the aerosol is generated, plus an aerosol generator or atomizer such as a heater operable to vaporize the aerosolizable material. A similar three-component system may include a separate mouthpiece that attaches to the article. In many designs, the article is designed to be disposable, in that it is intended to be detached from the device and thrown away when the aerosolizable material has been consumed. The user obtains a new article which has been prefilled with aerosolizable material by a manufacturer and attaches it to the device for use. The device, in contrast, is intended to be used with multiple consecutive articles, with a capability to recharge the battery to allow prolonged operation.

While disposable articles, which may be called consumables, are convenient for the user, they may be considered wasteful of natural resources and hence detrimental to the environment. An alternative design of article is therefore known, which is configured to be refilled with aerosolizable material by the user. This reduces waste, and can reduce the cost of electronic cigarette usage for the user. The aerosolizable material may be provided in a bottle, for example, from which the user squeezes or drips a quantity of material into the article via a refilling orifice on the article. However, the act of refilling can be awkward and inconvenient, since the items are small and the volume of material involved is typically low. Alignment of the juncture between bottle and article can be difficult, with inaccuracies leading to spillage of the material. This is not only wasteful, but may also be dangerous. Aerosolizable material frequently contains liquid nicotine, which can be poisonous if it makes contact with the skin.

Therefore, refilling units or devices have been proposed, which are configured to receive a bottle or other reservoir of aerosolizable material plus a refillable article, and to automate the transfer of the material from the former to the latter. Alternative, improved or enhanced features and designs for such refilling devices are therefore of interest.

SUMMARY

According to a first aspect of some embodiments described herein, there is provided a refilling device for filling an article from a reservoir, comprising: an article interface for receiving an article of an aerosol provision system, the article having a storage area for fluid and an atomizer having porosity for absorbing fluid from the storage area and comprising an electrically conductive heating member for vaporizing the absorbed fluid; and a controller configured to: supply electrical power to produce electrical current flow in the heating member of an article received in the article interface during a heating period to cause heating of the heating member; and execute a filling action to deliver fluid to the storage area of the article after the heating period.

According to a second aspect of some embodiments described herein, there is provided a refilling device for filling an article from a reservoir, comprising: an article interface for receiving an article of an aerosol provision system, the article having a storage area for fluid and an atomizer having porosity for absorbing fluid from the storage area and comprising an electrically conductive heating member for vaporizing the absorbed fluid; an air pump for removing air from inside an article received in the article interface; and a controller configured to: execute a filling action to deliver fluid to the storage area of the article; and during the filling action and/or on completion of the filling action, operate the air pump to reduce air pressure inside the article for a wetting period to promote flow of fluid from the storage area into the atomizer.

According to a third aspect of some embodiments described herein, there is provided an aerosol provision system comprising: a storage area for fluid; an atomizer having porosity for absorbing fluid from the storage area and comprising an electrically conductive heating member for vaporizing the absorbed fluid; a battery for supplying electrical power to cause heating of the heating member; a use status indicator indicating use of the heating member; and a controller configured to: determine use of the heating member from the use status indicator; and operate the battery to supply electrical power to produce electrical current flow in the heating member during a heating period to cause heating of the heating member if it is determined from the use status indicator that the heating member is unused.

These and further aspects of the certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, apparatus for conditioning refillable articles for aerosol provision systems may be provided in accordance with approaches described herein which includes any one or more of the various features described below as appropriate.

BRIEF DESCRIPTION OF THE DRAWINGS

Various embodiments of the invention will now be described in detail by way of example only with reference to the following drawings in which.

DETAILED DESCRIPTION

Figure 1:
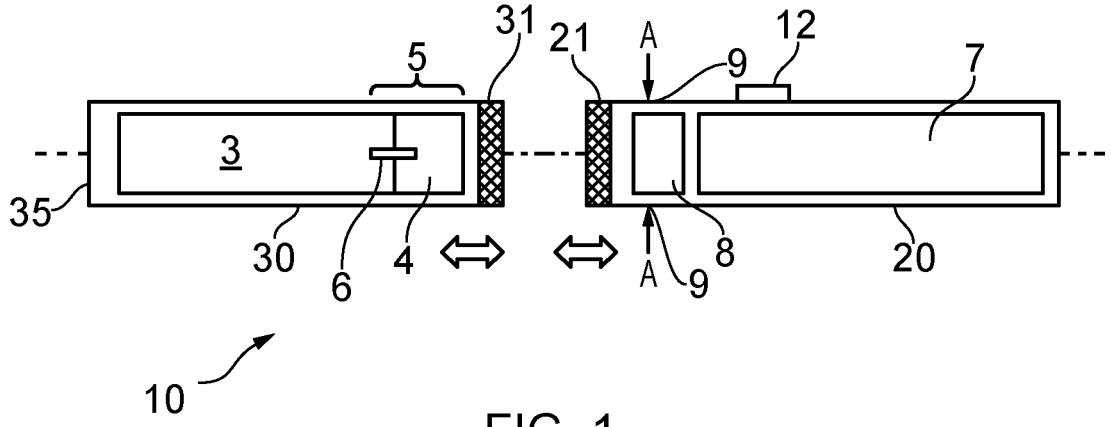
FIG. 1 shows a simplified schematic cross-section through an example electronic aerosol provision system in which embodiments of the present disclosure can be implemented.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to (but is not limited to) electronic aerosol or vapor provision systems, such as e-cigarettes. Throughout the following description the terms "e-cigarette" and "electronic cigarette" may sometimes be used; however, it will be appreciated these terms may be used interchangeably with aerosol (vapor) provision system or device. The systems are intended to generate an inhalable aerosol by vaporization of a substrate (aerosol-generating material) in the form of a liquid or gel which may or may not contain nicotine. Additionally, hybrid systems may comprise a liquid or gel substrate plus a solid substrate which is also heated. The solid substrate may be for example tobacco or other non-tobacco products, which may or may not contain nicotine. The terms "aerosol-generating material" and "aerosolizable material" as used herein are intended to refer to materials which can form an aerosol, either through the application of heat or some other means. The term "aerosol" may be used interchangeably with "vapor".

As used herein, the terms "system" and "delivery system" are intended to encompass systems that deliver a substance to a user, and include non-combustible aerosol provision systems that release compounds from an aerosolizable material without combusting the aerosolizable material, such as electronic cigarettes, tobacco heating products, and hybrid systems to generate aerosol using a combination of aerosolizable materials, and articles comprising aerosolizable material and configured to be used within one of these non-combustible aerosol provision systems. According to the present disclosure, a "non-combustible" aerosol provision system is one where a constituent aerosol generating material of the aerosol provision system (or component thereof) is not combusted or burned in order to facilitate delivery to a user. In some embodiments, the delivery system is a non-combustible aerosol provision system, such as a powered non-combustible aerosol provision system. In some embodiments, the non-combustible aerosol provision system is an electronic cigarette, also known as a vaping device or electronic nicotine delivery (END) system, although it is noted that the presence of nicotine in the aerosol generating material is not a requirement. In some embodiments, the non-combustible aerosol provision system is a hybrid system to generate aerosol using a combination of aerosolizable materials, one or a plurality of which may be heated. Each of the aerosolizable materials may be, for example, in the form of a solid, liquid or gel and may or may not contain nicotine. In some embodiments, the hybrid system comprises a liquid or gel aerosol generating material and a solid aerosol generating material. The solid aerosol generating material may comprise, for example, tobacco or a non-tobacco product.

Typically, the non-combustible aerosol provision system may comprise a non-combustible aerosol provision device and an article (consumable) for use with the non-combustible aerosol provision device. However, it is envisaged that articles which themselves comprise a means for powering an aerosol generator or aerosol generating component may themselves form the non-combustible aerosol provision system. In some embodiments, the non-combustible aerosol provision device may comprise a power source and a controller. The power source may, for example, be an electric power source. In some embodiments, the article for use with the non-combustible aerosol provision device may comprise an aerosol generating component (aerosol generator or atomizer), an aerosol generating area, a mouthpiece, and a storage area for receiving and holding aerosol generating material.

In some systems the aerosol generating component or aerosol generator comprises a heater capable of interacting with the aerosolizable material so as to release one or more volatiles from the aerosolizable material to form an aerosol. However, the disclosure is not limited in this regard, and aspects may apply also to systems that use other approaches to form aerosol, such as a vibrating mesh.

In the present disclosure, the article for use with the non-combustible aerosol provision device comprises a storage area for receiving fluid aerosolizable material. For example, the storage area may be a reservoir. In some embodiments, the area for receiving aerosolizable material may be separate from, or combined with, an aerosol generating area. In some embodiments, the article for use with the non-combustible aerosol provision device may comprise a mouthpiece As used herein, the term "component" may be used to refer to a part, section, unit, module, assembly or similar of an electronic cigarette or similar device that incorporates several smaller parts or elements, possibly within an exterior housing or wall. An aerosol provision system such as an electronic cigarette may be formed or built from one or more such components, such as an article and a device, and the components may be removably or separably connectable to one another, or may be permanently joined together during manufacture to define the whole system. The present disclosure is applicable to (but not limited to) systems comprising two components separably connectable to one another and configured, for example, as an article in the form of an aerosolizable material carrying component holding liquid or another aerosolizable material (alternatively referred to as a cartridge, cartomizer, pod or consumable), and a device having a battery or other power source for providing electrical power to operate an aerosol generating component or aerosol generator for creating vapor/aerosol from the aerosolizable material. A component may include more or fewer parts than those included in the examples.

The present disclosure relates to aerosol provision systems and components thereof that utilize aerosolizable material in the form of a liquid or a gel which is held in a storage area such as a reservoir, tank, container or other receptacle comprised in the system, or absorbed onto a carrier substrate. An arrangement for delivering the material from the reservoir for the purpose of providing it to an aerosol generator for vapor/aerosol generation is included. The terms "liquid", "gel", "fluid", "source liquid", "source gel", "source fluid" and the like may be used interchangeably with terms such as "aerosol-generating material", "aerosolizable substrate material" and "substrate material" to refer to material that has a form capable of being stored and delivered in accordance with examples of the present disclosure.

FIG. 1 is a highly schematic diagram (not to scale) of a generic example electronic aerosol/vapor provision system such as an e-cigarette 10, presented for the purpose of showing the relationship between the various parts of a typical system and explaining the general principles of operation. Note that the present disclosure is not limited to a system configured in this way, and features may be modified in accordance with the various alternatives and definitions described above and/or apparent to the skilled person. The e-cigarette 10 has a generally elongate shape in this example, extending along a longitudinal axis indicated by a dashed line, and comprises two main components, namely a device 20 (control or power component, section or unit), and an article or consumable 30 (cartridge assembly or section, sometimes referred to as a cartomizer, clearomizer or pod) carrying aerosol-generating material and operating to generate vapor/aerosol.

The article 30 includes a storage area such as a reservoir 3 for containing a source liquid or other aerosol-generating material comprising a formulation such as liquid or gel from which an aerosol is to be generated, for example containing nicotine. As an example, the source liquid may comprise around 1% to 3% nicotine and 50% glycerol, with the remainder comprising roughly equal measures of water and propylene glycol, and possibly also comprising other components, such as flavorings. Nicotine-free source liquid may also be used, such as to deliver flavoring. A solid substrate (not illustrated), such as a portion of tobacco or other flavor element through which vapor generated from the liquid is passed, may also be included. The reservoir 3 may have the form of a storage tank, being a container or receptacle in which source liquid can be stored such that the liquid is free to move and flow within the confines of the tank. In other examples, the storage area may comprise absorbent material (either inside a tank or similar, or positioned within the outer housing of the article) that holds the aerosol generating material. For a consumable article, the reservoir 3 may be sealed after filling during manufacture so as to be disposable after the source liquid is consumed. However, the present disclosure is relevant to refillable articles that have an inlet port, orifice or other opening (not shown in FIG. 1) through which new source liquid can be added to enable reuse of the article 30. The article 30 also comprises an aerosol generator 5, comprising in this example an aerosol generating component or atomizer, which may have the form of an electrically powered heating element or heater 4 and an aerosol-generating material transfer component 6. The heater 4 is located externally of the reservoir 3 and is operable to generate the aerosol by vaporization of the source liquid by heating. The aerosol-generating material transfer component 6 is a transfer or delivery arrangement configured to deliver aerosol-generating material from the reservoir 3 to the heater 4. In some examples, it may have the form of a wick or other porous element. A wick 6 may have one or more parts located inside the reservoir 3, or otherwise be in fluid communication with liquid in the reservoir 3, so as to be able to absorb source liquid and transfer it by wicking or capillary action to other parts of the wick 6 that are adjacent or in contact with the heater 4. This liquid is thereby heated and vaporized, and replacement liquid drawn, via continuous capillary action, from the reservoir 3 for transfer to the heater 4 by the wick 6. The wick may be thought of as a conduit between the reservoir 3 and the heater 4 that delivers or transfers liquid from the reservoir to the heater. In some designs, the heater 4 and the aerosol-generating material transfer component 6 are unitary or monolithic, and formed from a same material that is able to be used for both liquid transfer and heating, such as a material which is both porous and conductive. In still other cases, the aerosol-generating material transfer component may operate other than by capillary action, such as by comprising an arrangement of one or more valves by which liquid may exit the reservoir 3 and be passed onto the heater 4.

A heater and wick (or similar) combination, referred to above as an aerosol generator 5, may sometimes be termed an atomizer or atomizer assembly, and the reservoir with its source liquid plus the atomizer may be collectively referred to as an aerosol source. Various designs are possible, in which the parts may be differently arranged compared with the highly schematic representation of FIG. 1. For example, and as mentioned above, the wick 6 may be an entirely separate element from the heater 4, or the heater 4 may be configured to be porous and able to perform at least part of the wicking function directly (a metallic mesh or a porous ceramic element, for example). In the present example, the system is an electronic system, and the heater 4 may comprise one or more electrical heating elements that operate by ohmic/resistive (Joule) heating, or inductive heating may be used in which case the heater comprises a susceptor in an induction heating arrangement. A heater of this type could be configured in line with the examples and embodiments described in more detail below. In general, therefore, an atomizer or aerosol generator, in the present context, can be considered as one or more elements that implement the functionality of a vapor-generating element able to generate vapor by heating source liquid (or other aerosol-generating material) delivered to it, and a liquid transport or delivery element able to deliver or transport liquid from a reservoir or similar liquid store to the vapor-generating element by a wicking action/capillary force or otherwise. The present disclosure is mainly concerned with configurations in which the aerosol generator is housed in an article 30 of an aerosol generating system, as in FIG. 1, but sometimes at least the heater part may be housed in the device 20. Embodiments of the disclosure are applicable to all and any such configurations which are consistent with the examples and description herein.

Returning to FIG. 1, the article 30 also includes a mouthpiece or mouthpiece portion 35 having an opening or air outlet through which a user may inhale the aerosol generated by the heater 4.

The device 20 includes a power source such as cell or battery 7 (referred to hereinafter as a battery, and which may or may not be re-chargeable) to provide electrical power for electrical components of the e-cigarette 10, in particular to operate the heater 4. Additionally, there is a controller 8 such as a printed circuit board and/or other electronics or circuitry for generally controlling the e-cigarette. The controller may include a processor programmed with software, which may be modifiable by a user of the system. The control electronics/circuitry 8 operates the heater 4 using power from the battery 7 when vapor is required. At this time, the user inhales on the system 10 via the mouthpiece 35, and air A enters through one or more air inlets 9 in the wall of the device 20 (air inlets may alternatively or additionally be located in the article 30). When the heater 4 is operated, it vaporizes source liquid delivered from the reservoir 3 by the aerosol-generating material transfer component 6 to generate the aerosol by entrainment of the vapor into the air flowing through the system, and this is then inhaled by the user through the opening in the mouthpiece 35. The aerosol is carried from the aerosol generator 5 to the mouthpiece 35 along one or more air channels (not shown) that connect the air inlets 9 to the aerosol generator 5 to the air outlet when a user inhales on the mouthpiece 35.

More generally, the controller 8 is suitably configured/programmed to control the operation of the aerosol provision system to provide functionality in accordance with embodiments and examples of the disclosure as described further herein, as well as for providing conventional operating functions of the aerosol provision system in line with established techniques for controlling such devices. The controller 8 may be considered to logically comprise various sub-units/circuitry elements associated with different aspects of the aerosol provision system's operation in accordance with the principles described herein and other conventional operating aspects of aerosol provision systems, such as display driving circuitry for systems that may include a user display (such as an screen or indicator) and user input detections via one or more user actuable controls 12. It will be appreciated that the functionality of the controller 8 can be provided in various different ways, for example using one or more suitably programmed programmable computers and/or one or more suitably configured application-specific integrated circuits/circuitry/chips/chipsets configured to provide the desired functionality.

The device 20 and the article 30 are separate connectable parts detachable from one another by separation in a direction parallel to the longitudinal axis, as indicated by the double-headed arrows in FIG. 1. The components 20, 30 are joined together when the system 10 is in use by cooperating engagement elements 21, 31 (for example, a screw or bayonet fitting) which provide mechanical and in some cases electrical connectivity between the device 20 and the article 30. Electrical connectivity is required if the heater 4 operates by ohmic heating, so that current can be passed through the heater 4 when it is connected to the battery 5. In systems that use inductive heating, electrical connectivity can be omitted if no parts requiring electrical power are located in the article 30. An inductive work coil can be housed in the device 20 and supplied with power from the battery 5, and the article 30 and the device 20 shaped so that when they are connected, there is an appropriate exposure of the heater 4 to flux generated by the coil for the purpose of generating current flow in the material of the heater. The FIG. 1 design is merely an example arrangement, and the various parts and features may be differently distributed between the device 20 and the article 30, and other components and elements may be included. The two sections may connect together end-to-end in a longitudinal configuration as in FIG. 1, or in a different configuration such as a parallel, side-by-side arrangement. The system may or may not be generally cylindrical and/or have a generally longitudinal shape. Either or both sections or components may be intended to be disposed of and replaced when exhausted, or be intended for multiple uses enabled by actions such as refilling the reservoir and recharging the battery. In other examples, the system 10 may be unitary, in that the parts of the device 20 and the article 30 are comprised in a single housing and cannot be separated. Embodiments and examples of the present disclosure are applicable to any of these configurations and other configurations of which the skilled person will be aware, but are most generally concerned with configurations comprising an article with a refillable storage area.

The present disclosure relates to the filling and refilling of a storage area for aerosol generating material in an aerosol provision system, whereby a user is enabled to conveniently provide a system with fresh aerosol generating material when a previous stored quantity has been used up or to obtain an initial quantity of aerosol generating material to enable a first use of the system. It is proposed that this be done automatically, by provision of apparatus which is termed herein a refilling device, refilling unit, refilling station, or simply dock. The refilling device is configured to receive an aerosol provision system, or more conveniently, the article from an aerosol provision system, having a storage area which is empty (either because the user obtains a new and unused empty article for the system, or because the user has consumed a previously stored quantity of aerosol generating material) or only partly full, plus a larger reservoir holding aerosol generating material. A fluid communication flow path is established between the reservoir and the storage area, and a controller in the refilling device controls a transfer mechanism or arrangement operable to move aerosol generating material along the flow path from the reservoir to the storage area. The transfer mechanism can be activated in response to user input of a refill request to the refilling device, or activation may be automatic in response to a particular state or condition of the refilling device detected by the controller. For example, if both an article and a reservoir are correctly positioned inside the refilling unit, refilling may be carried out. Once the storage area is replenished with a desired quantity of aerosol generating material (the storage area is filled or a user specified quantity of material has been transferred to the article, for example), the transfer mechanism is deactivated, and transfer ceases. Alternatively, the transfer mechanism may be configured to automatically dispense a fixed quantity of aerosol generating material in response to activation by the controller, such as a fixed quantity matching the capacity of the storage area.

Figure 2:
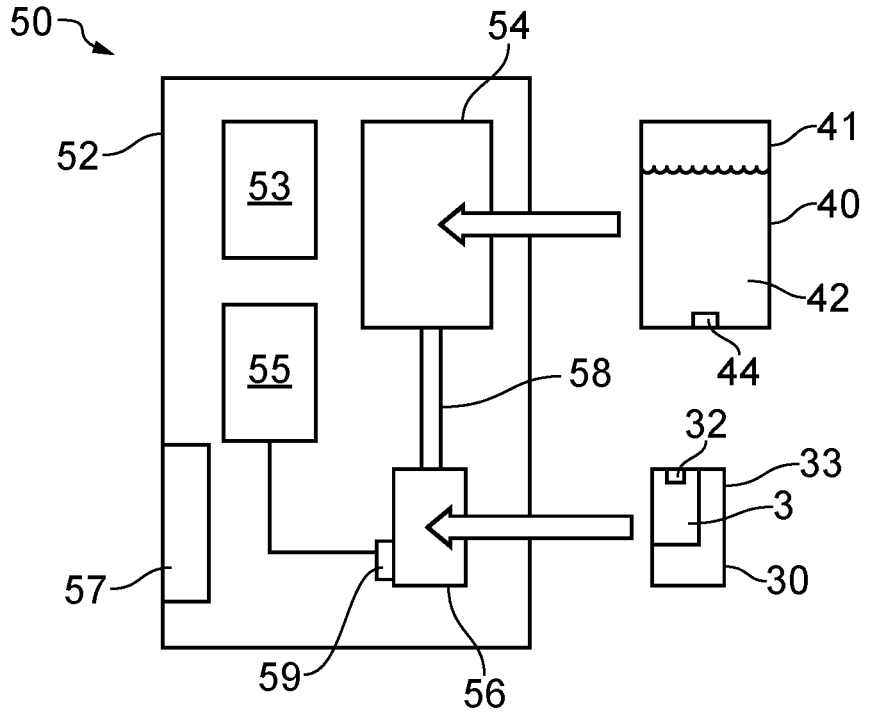
FIG. 2 shows a simplified schematic representation of a refilling device to which embodiments of the present disclosure are applicable.

FIG. 2 shows a highly schematic representation of an example refilling device. The refilling device is shown in a simplified form only, to illustrate various elements and their relationship to one another. More particular features of one or more of the elements with which the present disclosure is concerned will be described in more detail below.

The refilling device 50 may be referred to hereinafter for convenience as a "dock". This term is applicable since a reservoir and an article are received or "docked" in the refilling device during use. The dock 50 comprises an outer housing 52. The dock 50 is expected to be useful for refilling of articles in the home or workplace (rather than being a portable device or a commercial device, although these options are not excluded). Therefore, the outer housing, made for example from metal, plastics or glass, may be designed to have an pleasing outward appearance such as to make it suitable for permanent and convenient access, such as on a shelf, desk, table or counter. It may be any size suitable for accommodating the various elements described herein, such as having dimensions between about 10 cm and 20 cm, although smaller or larger sizes may be preferred. Inside the housing 50 are defined two cavities or ports 54, 56. A first port 54 is shaped and dimensioned to receive and interface with a reservoir 40. The first or reservoir port 54 is configured to enable an interface between the reservoir 40 and the dock 50, so might alternatively be termed a reservoir interface. Primarily, the reservoir interface is for moving aerosol generating material out of the reservoir 40, but in some cases the interface may enable additional functions, such as electrical contacts and sensing capabilities for communication between the reservoir 40 and the dock 50 and determining characteristics and features of the reservoir 40.

The reservoir 40 comprises a wall or housing 41 that defines a storage space for holding aerosol generating material 42. The volume of the storage space is large enough to accommodate many or several times the storage area of an article intended to be refilled in the dock 50. A user can therefore purchase a filled reservoir of their preferred aerosol generating material (flavor, strength, brand, etc.), and use it to refill an article multiple times. A user could acquire several reservoirs 40 of different aerosol generating materials, so as to have a convenient choice available when refilling an article. The reservoir 40 includes an outlet orifice or opening 44 by which the aerosol generating material 42 can pass out of the reservoir 40. In the current context, the aerosol generating material 42 has a liquid form or a gel form, so may be considered as aerosol generating fluid. The term "fluid" may be used herein for convenience to refer to either a liquid or a gel material; where the term "liquid" is used herein, it should be similarly understood as referring to a liquid or a gel material, unless the context makes it clear that only liquid is intended.

A second port 56 defined inside the housing is shaped and dimensioned to receive and interface with an article 30. The second or article port 54 is configured to enable an interface between the article 30 and the dock 50, so might alternatively be termed an article interface. The article interface 56 is for receiving aerosol generating material into the article 30, and may enable additional functions, such as electrical contacts and sensing capabilities (indicating generally as sensor/contact 59) for communication between the article 30 and the dock 50 and determining characteristics and features of the article 30. In particular, the article interface 56 is configured to enable one or more pre-treatment processes which the dock 50 applies to an article 30 received in the article interface 54 before or after aerosol generating material is delivered from the reservoir 40 to the article 30 in order to prepare the article 30 for use with a device of an aerosol provision system.

The article 30 itself comprises a wall or housing 33 that has within it (but possibly not occupying all the space within the wall 31) a storage area 3 for holding aerosol generating material. The volume of the storage area 3 is many or several times smaller than the volume of the reservoir 40, so that the article 30 can be refilled multiple times from a single reservoir 40. The article also includes an inlet orifice or opening 32 by which aerosol generating material can enter the storage area 3. Various other elements may be included in the article, as discussed above with regard to FIG. 1. For convenience, the article 30 may be referred to hereinafter as a pod 30.

The housing 52 of the dock also accommodates a fluid conduit 58, being a passage or flow path by which the reservoir 40 and the storage area 3 of the article 30 are placed in fluid communication, so that aerosol generating material can move from the reservoir 40 to the article 30 when both the reservoir 40 and the article 30 are correctly positioned in the dock 50. Placement of the reservoir 40 and the article 30 into the dock 50 locates and engages them such that the fluid conduit 58 is connected between the outlet orifice 44 of the reservoir 40 and the inlet orifice 32 of the article 30. Note that in some examples, all or part of the fluid conduit 58 may be formed by parts of the reservoir 40 and the article 30, so that the fluid conduit is created and defined only when the reservoir 40 and/or the article 30 are placed in the dock 30. In other cases, the fluid conduit 58 may be a flow path defined within a body of the dock 52, to each end of which the respective orifices are engaged.

Access to the reservoir port 54 and the article port 56 can be by any convenient means. Apertures may be provided in the housing 52 of the dock 50, through which the reservoir 40 and the article 30 can be placed or pushed. Doors or the like may be included to cover the apertures, which might be required to be placed in a closed state to allow refilling to take place. Doors, hatches and other hinged coverings, or sliding access elements such as drawers or trays might include shaped tracks, slots or recesses to receive and hold the reservoir 40 or the article 30, which bring the reservoir 40 or the article 30 into proper alignment inside the housing when the door etc. is closed. These and other alternatives will be apparent to the skilled person, and do not affect the scope of the present disclosure.

The dock 50 also includes an aerosol generating material ("liquid" or "fluid") transfer mechanism, arrangement, apparatus or means 53, operable to move or cause the movement of fluid out of the reservoir 40, along the conduit 58 and into the article 30. Various options are contemplated for the transfer mechanism 53.

As already noted, a controller 55 is also included in the dock 50. This is operable to control components of the dock 50, in particular to generate and send control signals to operate the transfer mechanism, and to operate features of the dock 50 (not shown in FIG. 2) which enable the pre-treatment processes explained further below. As noted above, operation of these parts may be in response to a user input, such as actuation of a button or switch (not shown) on the housing 52, or automatically in response to both the reservoir 40 and the article 30 being detected as present inside their respective ports 54, 56. The controller 55 may therefore be communication with contacts and/or sensors (such as the sensors 59 but otherwise not shown) at the ports 54, 56 in order to obtain data from the ports and/or the reservoir 40 and article 30 that can be used in the generation of control signals for operating the transfer mechanism 53 and providing the pre-treatment processes. The controller 55 may comprise a microcontroller, a microprocessor, or any configuration of circuitry, hardware, firmware or software as preferred; various options will be apparent to the skilled person.

Finally, the dock 50 includes a power source 57 to provide electrical power for the controller 53, features for enabling the pre-treatment processes, and any other electrical components that may be included in the dock, such as sensors, user inputs such as switches, buttons or touch panels, and display elements such as light emitting diodes and display screens to convey information about the dock's operation and status to the user. Also, the transfer mechanism may be electrically powered. Since the dock may be for permanent location in a house or office, the power source 57 may comprise a socket for connection of an electrical mains cable to the dock 50, so that the dock 50 may be "plugged in". Alternatively, the power source may comprise one or more batteries, which might be replaceable or rechargeable, in which case a socket connection for a charging cable can be included.

Further details relating to the contemplated pre-treatment processes and control of the refilling will now be described.

A new article acquired by a user from a supplier or manufacturer may be pre-filled and ready for a first use. Alternatively, however, new articles are provided to the user with an empty storage area, and the user uses the dock to fill the storage area, and subsequently refill the storage area when the aerosol generating material (hereinafter referred to as "fluid" for convenience) has been consumed. This arrangement can increase the pre-sale shelf life of an article because deterioration of the fluid is not a consideration, and also avoids the risk of leakage of the fluid during manufacture, shipping, and pre- and post-sale storage of the article. However, it has been recognised that the atomizer of a previously unfilled article may be in suboptimal condition for vapor generation if the article is simply filled and then directly coupled into an aerosol provision system for use by the user. Pre-treatment or conditioning of the atomizer before first use of the article can address such issues by placing the article in an improved condition for use, and pre-treatment can conveniently be performed by the refill dock while the article is received for filling, as an adjunct to the filling process. The term "pre-treatment" signifies a treatment carried out before use of the article in an aerosol provision system to generate aerosol/vapor for consumption by the user; note that a pre-treatment may take place before or after filling of the article's storage area depending on the nature of the process. While the pre-treatments are particularly relevant for new articles in which the atomizer has not been used, they may also be useful for articles which have been previously used, but where the atomizer may have deteriorated or reverted towards its pre-used condition such as after a period of non-use.

Two types of pre-treatment are contemplated, which are applicable to various designs of atomizer, and which can be applied individually or sequentially. A first example is a pre-heating process which is carried out in the absence of fluid in the article, and therefore before filling of the storage area from the reservoir of the refilling dock. A second example is a pre-wetting process which is carried out in the presence of fluid in the article, and therefore during or after filling of the storage area.

The atomizer of an article may have the form of a porous electrically conductive member which is able to both absorb fluid from the storage area of the article, and be heated by the flow of electrical current through it. In this way, a single component is able to perform both wicking and vaporizing of the fluid. The member is formed from a material having a porous structure, that may be provided in a variety of ways, and the electrical conductivity allows the flow of electrical current which raises the temperature of the member. As an example, the member may be formed from a conductive metallic material, which may be made into a porous structure by being configured as metallic fibers or particles which are woven, sintered or otherwise joined together to form a unified conglomerate structure that has interstices between the fibers or particles to provide the porous structure. The member thereby may have the form of a mesh, a grill, a grid or a randomly arranged mass of fibers. The metallic nature of the material enables electrical conductivity. As an example, the metallic material may be stainless steel, but other metals or metallic alloys may also be used. As an alternative, ceramic materials which are electrically conductive, and have an inherent porosity are also known and may be used. The porous electrically conductive heating member may conveniently have a planar shape, which maximises the surface area available for vaporization and allows all absorbed fluid to be relatively close to the surface for the escape of the vapor. Other shapes may be used, however, for both metallic and ceramic members. When installed as an atomizer in a newly-fabricated article with an empty fluid storage area, the atomizer may remain dry and unused for a considerable period before its first use. During this time, a deterioration of the heating member may occur. For example, since the heating member is exposed to air, and has a large surface area, significant oxidation of the material from which it is formed, such as metal fibers, can occur. The oxidation, or other atmospheric reactions or deposits from the atmosphere, forms atmospheric contaminants which degrade the surface of the heating member. The porous structure may become clogged by the contaminants, which makes subsequent absorption of fluid from the storage area, when it is eventually filled, inefficient, leading to poor vapor production and a possible bad taste of the vapor. The resistance of the heating member may also be modified by the changes, distorting the intended heating performance and vapor production of the heating member. However, such contaminants can be reduced or removed by heating the heating element. Accordingly, it is proposed that a pre-treatment for an article can comprise a heating period during which the temperature of the atomizer is raised; this refurbishes the atomizer and restores its surface to or towards its original condition. Effective absorption of the fluid can then take place once the article has been filled, and vapor generation can take place as intended. This pre-heating process can be carried out by supplying electrical power to the heating member once the article is received in the refilling dock for filling, causing electrical current flow and a temperature increase. Once the pre-heating has been performed, the article's storage area is filled from the reservoir of the refilling dock.

Figure 3:
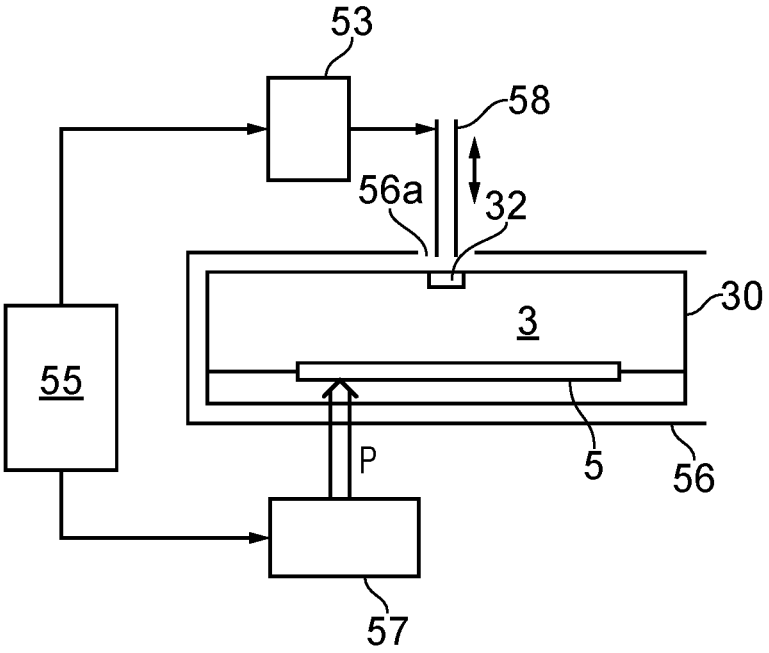
FIG. 3 shows a schematic and simplified representation of some components and parts of a first example refilling device according to embodiments of the present disclosure.

FIG. 3 shows a highly schematic and simplified representation of some of the components and parts of an example refilling dock such as that shown in FIG. 2, and for which like reference numerals are used where appropriate. Only those parts of the dock which are most relevant to the pre-heating process are shown, for the sake of simplicity. An article interface 56 is provided, into which an article 30 is inserted or received. In this example, the article 30 has an elongate shape with a inlet orifice 32 on its side, and is inserted lengthwise and horizontally into the article interface 56 of the dock so that the inlet orifice 32 faces upwards. An opening 56*a* in the upper wall of the article interface 56 allows a fluid conduit 58 to enter the article interface 56 and engage with the inlet orifice for the purpose of delivering fluid from a reservoir (not shown) into a storage area 3 in the article 30. The fluid conduit is part of a fluid transfer mechanism 53 which is controlled by a controller 55 of the dock to perform the delivery of a required amount fluid from the reservoir to the storage area 3 when the fluid conduit 58 is engaged with the inlet orifice 32; this may achieved by movement of fluid conduit 58 towards the article 3, and/or vice versa.

The article has an atomizer 5 in the form of a porous and electrically conductive heating member, as discussed above. The atomizer 5 is arranged so as to be able to absorb fluid from the storage area 2. For example, the atomizer 5 may be arranged with one or more edges, sides, ends or surfaces within the interior of the storage area 3 so that it can be in contact fluid in the storage area 3 once the storage area 3 has been filled with fluid. An accurate depiction of any such arrangement is not attempted in FIG. 3; both the storage area 3 and the atomizer 5 are shown schematically only, with the necessary adjacent spatial relationship suggested.

The dock further comprises a power source 57 (which may be internal or external to the dock, as described above). In order to perform the preheating treatment process, the controller 55 is configured to control the power source to supply electrical power P so as to produce a flow of electrical current in the atomizer 5. This causes the atomizer to heat up, thereby destroying, changing, driving off or otherwise removing contaminants that may have accumulated on the atomizer 5 during a period of non-use. The current flow is provided for the duration of a heating period, sufficient to allow a satisfactory removal of contaminants. Typically, the heating period will have a duration of 10 seconds or less, so the process is not unduly time consuming. Indeed, suitable heating can be achieved in a much shorter time periods, for example as little as 3 seconds. Shorter or longer heating periods may alternatively be used however, as convenient or appropriate. Usefully, the atomizer may have its temperature increased to 500° C., although lower temperatures may be used. More generally therefore, the atomizer temperature may be increased by the heating period to a temperature in the range of 200° C. to 500° C., or in the range 400° C. to 500° C. Other temperatures are not excluded, however. Once the end of the heating period is reached, the controller 55 controls the power source 57 to cease supply of the power P and the flow of current in the atomizer 5.

Once the heating has been applied for the duration of the heating period, the atomizer 5 has been wholly or partly restored to its original condition, and/or had its properties or condition for use in vapor generation enhanced compared with prior to the heating period, and is suitable for safe and efficient vapor generation via absorption and vaporization of fluid from the storage area 3. To enable this, it is necessary to proceed to filling the storage area 3. Accordingly, after the heating period has come to an end, the controller 55 executes a filling action, by appropriate control of the transfer mechanism 53 to move fluid out of the reservoir, along the fluid conduit 58 and into the storage area 3 while the fluid conduit is engaged with the inlet orifice 32. This engagement may made before, after or during the heating period. Once a desired amount of fluid has been delivered into the storage area 3, the filling action completes by disengagement of the fluid conduit 58 from the inlet orifice 32, and the article can be removed from the article interface 56 and is ready for use.

The electrical current flow in the atomizer may be caused so as to generate heating by resistive heating or by inductive heating.

Figure 4:
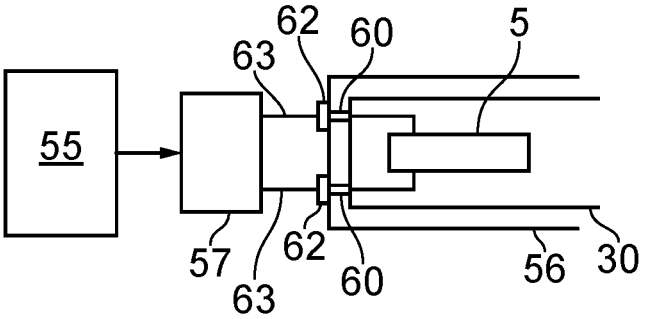
FIG. 4 shows a schematic and simplified representation of some components and parts of a second example refilling device according to embodiments of the present disclosure.

FIG. 4 shows a simplified and highly schematic representation of part of an example dock, where for simplicity only components relevant to the pre-heating process are included. In this example, the dock is configured to implement the heating period by resistive heating. This requires electrical contact to be made between the power supply 57 and the atomizer 5 of the article 30 once the article 30 is received in the article interface 56. Accordingly, a pair of electrical contacts 62 is provided on an inner surface of the wall defining the article interface 56, with appropriate electrical connections 63 to the power supply 57. The article 30 has complementary electrical contacts 60 provided on an outer surface at positions that enable the electrical contacts 60 on the article 30 to make contact with the electrical contacts 62 in the article interface 56. The electrical contacts 60 of the article 30 have electrical connections to the atomizer 5 (not shown) so that when the article 30 is received in the article interface 56, an electrical circuit is formed comprising the power supply 57 and the atomizer 5. The controller 55 sends appropriate control signals to the power supply 57 in order to supply electrical power to the circuit and cause current to flow through the atomizer 5, which heats up by the action of resistive heating. A current of around 1 A may be used, for example in the range of 0.5 A to 1.5 A, or 0.5 A to 2 A, or 1 A to 2 A. The electrical contacts 60 on the atomizer 30 may be dedicated contacts for the express purpose of electrically connecting the article 30 to the dock (for the pre-heating, and possibly other purposes outwith the scope of this disclosure), but more conveniently they may be electrical contacts provided on the article 30 for the purpose of making electrical connection between the article 30 and a device to which the article is coupled to form an aerosol provision system, so that a battery in the device can power the atomizer 5 when vapor generation is required. Hence, the pre-heating process can be implemented with no or few additional components required for the dock or the article 30.

Figure 5:
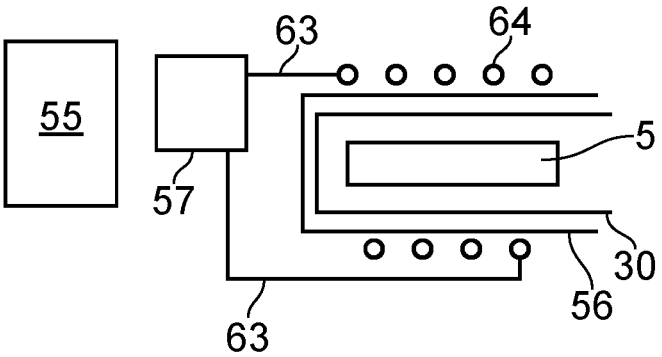
FIG. 5 shows a schematic and simplified representation of some components and parts of a third example refilling device according to embodiments of the present disclosure.

FIG. 5 shows a simplified and highly schematic representation of part of an example dock, where for simplicity only components relevant to the pre-heating process are included. In this example, the dock is configured to implement the heating period by inductive heating. There are designs of aerosol provision system which use inductive heating to operate the heating element part of the atomizer. In such an arrangement, the heating element is configured as the susceptor of an inductive heating system, and an induction work coil is provided typically in the device part of eth aerosol provision system. the article and the device are shaped such that a part of the article housing the heating element is inserted into a cavity in the device which is surrounded by the work coil. The battery of the device supplies electrical power to the work coil which generates a magnetic field in which heating element is located, and which induces electrical current flow in the heating element to produce heating, in the known manner. An advantage of inductive heating configured in this way is that no electrical contact is needed between the article and the device. The same arrangement can be used to heat the atomizer of an article for a pre-heating process. Inductive heating may be convenient for treating articles with an atomizer which is specifically designed as a susceptor for inductive heating in its aerosol provision system. Alternatively it may be employed with an article that uses resistive heating for vapor generation, if the heating element is nevertheless of a suitable configuration for inductive heating. This might be of benefit if it is desired to avoid electrical connection between the article and the dock, for example. Accordingly, as shown in FIG. 5, an induction work coil 64 is included in the dock, arranged so that the article interface 56 is a cavity in the void within the coil. Hence, inserting the article 30 into the article interface 56 places the atomizer 5 within the magnetic field induced by the coil 64 when it is supplied with electrical power from the power supply 57. As before, the controller 55 is configured to control the supply of the electrical power from the power supply 57, so that current flow is induced in the atomizer 5 for the duration of the heating period.

Figure 6:
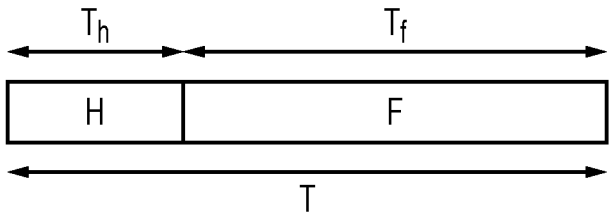
FIG. 6 shows a schematic timeline of a first example operating period of a refilling device according to embodiments of the present disclosure.

FIG. 6 shows a schematic representation of a first example operating period or timeline for a refilling dock or refilling device configured to provide a pre-heating treatment to an article. After the article is received in the article interface of the dock, the power supply is activated to provide the heating period, which has a duration Th. When the heating period is complete, the controller implements the filling action to deliver fluid into the storage area of the article, which occupies a filling period Tf. The heating period and the filling period together have a combined duration T. typically the filling period will be longer than the heating period, but may not be. Overall, it is expected that both the heating and the filling can be performed in a relatively short time period, for example for a total duration of 2 minutes or less. This is considered to be useful and efficient operation period for user convenience. As represented in the timeline of FIG. 6, the filling action is executed directly the heating period expires.

However, the supply of fluid directly into the articles storage area may enable vapor generation if the atomizer absorbs fluid when it is still at an elevated temperature. This is wasteful of the fluid, and can also cause vapor to enter the interior of the refilling dock, via the mouthpiece outlet of the article. The presence of vapor inside the dock may damage the dock's components, particularly electrical parts so is undesirable. Hence, it is proposed that, if vapor generation is likely to be a problem (if the heating period raises the temperature of the atomizer to a level sufficient for vaporization to occur), a cooling period is introduced between the heating period and the filling action.

Figure 7:
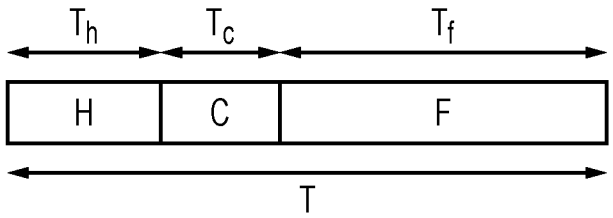
FIG. 7 shows a schematic timeline of a second example operating period of a refilling device according to embodiments of the present disclosure.

FIG. 7 shows a schematic representation of a second example operating period or timeline for a refilling dock or refilling device configured to provide a pre-heating treatment to an article. As before, operation commences with a heating period H of duration Th. Now, however, there is a break before the filling action is initiated, to provide a cooling period C of duration Tc to allow heat to dissipate from the atomizer. Once the atomizer has cooled to a temperature at or below which vaporization of fluid is not likely to occur, the filling action F begins, lasting for a duration Tf. The temperature reached by the atomizer during the heating period H is such that the relatively small and thin atomizer can cool relatively quickly, so that the cooling period length Tc can be of the order of 10 seconds or less only, such as in the range of 1 to 10 seconds. Overall it is useful for the combined duration T=Th+Tc+Tf to again be not longer than about 2 minutes, although longer total operating periods may be necessary to fully implement an adequate cooling period.

As described above, the pre-heating treatment is particularly useful for refurbishing the atomizer of a new and unused article. It may not be desirable to implement pre-heating with an article which has already been used for vapor generation, since any fluid remaining in the porous structure of the atomizer might be vaporized within the dock when the atomizer heats up. In order to address this, it is proposed that pre-heating can be limited to articles which have not previously been filled. The article may be equipped with a fill status indicator which can be read or detected by the controller when the article is received in the article interface. If the controller determines that the article has not previously been filled, pre-heating is performed before filling the article. If the controller determines that the article has previously been filled, the pre-heating is omitted and the controller proceeds directly to execution of the filling action. When the filling action is performed for the first time, the controller modifies the article so that the fill status indicator indicates that the dock has been filled. When the article is subsequently returned to the dock for refilling, the controller can determine from the fill status indicator that this is not the first fill, and omits the heating period.

Figure 8:
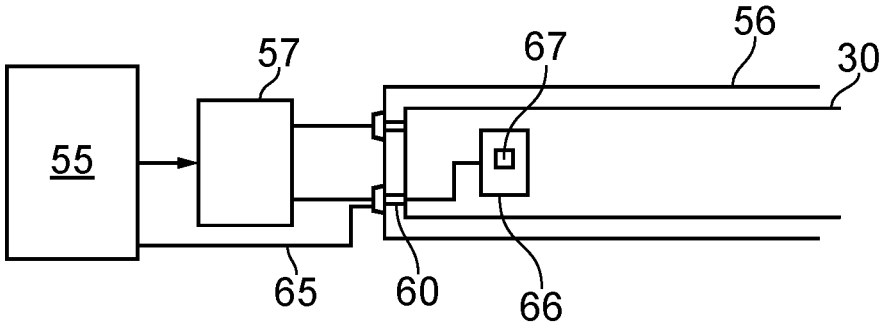
FIG. 8 shows a schematic and simplified representation of some components and parts of a fourth example refilling device and article according to embodiments of the present disclosure.

FIG. 8 shows a schematic representation of a first example of a dock and article configured for fill status indication. Parts not relevant to fill status determination are omitted for clarity. The article 30 comprises a readable and writable memory or data storage element 66 in which fill status data 67 are stored. (A memory chip may be included in the article for other purposes such as storing data relating to properties and characteristics of the article that may be used by the aerosol provision system to inform vapor generating operation. The same memory may be used for both purposes, or a dedicated memory may be provided for fill status indication only). The data may comprise for example a flag which can be set to 0 or 1, although other data configurations that indicate one of two different states can be used and will be apparent to the skilled person. The memory is electrically connected such that it can be interrogated via electrical contacts 60 on the exterior of the article; and the article interface is configured to connect with these electrical contacts. Suitable electrical connections 65 are provided within the dock for the controller 55 to access the memory 66 and read the fill status data 67 when the article 30 is inserted into the article interface 56. When the article 30 is manufactured, the fill status data is set to indicate a fill status of "new", "unused" or "unfilled", such as by setting the flag to 0. When the article 30 is received in the article interface 56, the controller interrogates the memory 66 and finds that the fill status data indicates that the article is new and has not previously been filled. The controller then implements the heating period, followed by the filling action (with optionally an intermediate cooling period). The controller also writes to the memory 66 to change the fill status data 67 to indicate a fill status of "used" or "filled", such as by setting the flag to 1. This can be done at the same time as the initial accessing of the fill status data, before the heating and filling, or can be done as a separate action later, such as when the filling is complete. If the article is again inserted into the dock, the controller again reads the fill status data 67, and this time finds that the data 67 indicates that the article 30 has been previously filled. The controller omits the preheating and proceeds directly to the filling action.

Figure 9:
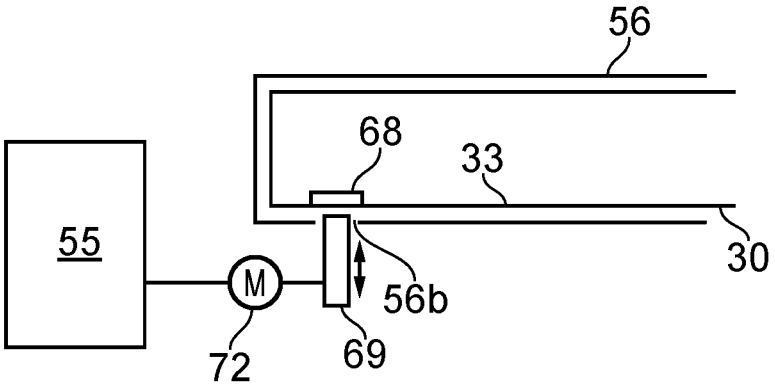
FIG. 9 shows a schematic and simplified representation of some components and parts of a fifth example refilling device and article according to embodiments of the present disclosure.

FIG. 9 shows a schematic representation of a second example of a dock and article configured for fill status indication. Parts not relevant to fill status determination are omitted for clarity. In this example, the fill status indicator takes a physical embodiment in place of the software-based embodiment of the first example. The article 30 has an outer housing 33 which includes a tab or tag 68 incorporated into it, which has a physical form that can be modified and which is accessible from the exterior of the article 30. Specifically, the tab 68 is able to have its structure or position altered from an original state in which it is intact on the housing 33 to a changed state, so that the dock can detect either of the two states and determine fill status therefrom. To enable this, the article interface 56 has an access opening 56*b* in its boundary wall. A movable ram or piston 69 is provided in the dock in alignment with the access opening 56*b*, and is able to be driven under control of the controller 55, for example by means of a motor 72, into and out of the access opening 56*b* in order to press against the tab 68 of the article 30 received in the article interface 56.

A new unused article 30 has its tab 68 intact and unmodified, for example with a surface largely flush with the outer surface of the housing, or possibly inset a little to protect it from accidental damage. When the article 30 is inserted into the article interface 56, the controller controls the ram 69 to move towards and against the tab 68. Impact of the ram 68 with the tab 68 is detected, for example by detecting a current spike at the motor 72 when the ram 86 meets the resistance against its forward motion provided by the tab 68. Other detection methods can be used, however. From this, the controller 55 determines that the article 30 has not previously been filled, and proceeds to execute the preheating process, followed by the filling action. Additionally, the ram 69 is advanced further so that the pressure of the end of the ram 69 against the tab 68 moves or damages the tag in such a way that it no longer occupies its original position. This can be done as a continuation of the initial ram advancement used to detect the intact condition of the tab 68, or as a separate step after filling. The ram 69 is then retracted out of the access opening 56*b* and the filled article 30 is able to be removed from the article interface 56 and used for vapor generation. When the article 30, now with a physically modified tab 68, is subsequently placed in the dock for refilling, the controller 55 again operates the ram 69. Now, the absence of the tab 68 at its original position means that the advancing ram 69 does not make contact with the tab 68 at the expected time/place, and the tab 68 is not detected. For example, there will be no current spike at the motor at the expected time. The controller 55 determines from this that the article has previously been filled, can retract the ram 69, and proceeds directly to execute the filling action without the preliminary heating period. It will be apparent that the tab can be made detectably modifiable in various ways, any of which may be used as appropriate. Some examples which use a ram are now discussed, but the invention is not limited in this way.

Figure 10:
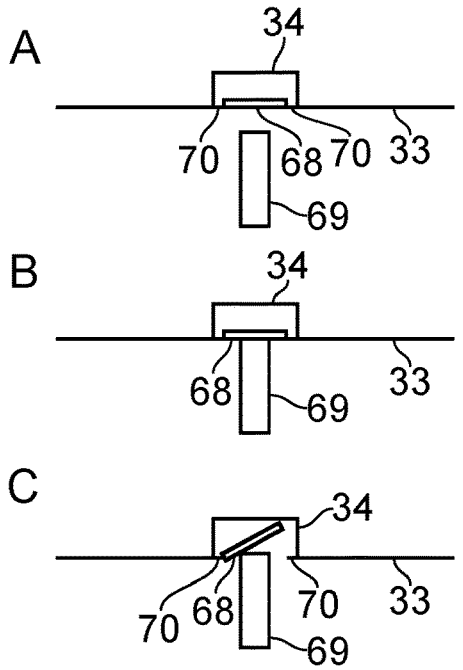
FIGS. 10A to 10C show schematic and simplified representations of some components and parts of a sixth example refilling device and article according to embodiments of the present disclosure.

FIG. 10 shows a series of schematic representations, 10A-10C of a first example of a modifiable tab fill status indicator, in its two indicator states. FIG. 10A shows part of the housing 33 of an article. The outer surface of the wall provided by the housing defines or has formed within is a recess or cavity 34. The tab 68 is a thin planar element located across the mouth of the recess 34, and is secured around its edges to the housing 33 by plastically deformable or frangible connector portions 70. The tab 68 may be integrally formed with the housing 33, or formed separately and attached to the housing 33. The connector portions 70 may be provided around the whole perimeter of the tab 68, but for ease of modification of the tab 68 may be provided on a single edge or two opposite edges, or at intervals around the perimeter. The connector portions 70 are configured to break and/or bend under application of a moderate force which is applied by the ram 69. The wall of the article interface is omitted from the Figures, for clarity. FIG. 10B shows the ram 69 in a partially advanced position at which it has made contact with the tab 68, which is detected by the dock's controller as described above. FIG. 10C shows the ram 69 in its fully advanced position, after its forward motion has caused it to press against the tab 68 and to break one of the connector portions 70, allowing the ram 69 to push the tab 68 into the recess 34. The opposite connector portion 70 has remained unbroken but has bent, so that the tab 68 is hinged inwardly into the recess 34. This may be a desirable arrangement since it stops the tab 68 being completely detached from the article housing 33 and falling loose into the interior of the dock. Hence, the connector portions 70 may be configured to enable this, with one connector portion 70 being less frangible that the other or others so that it does not break and can act as a hinge for the tab 68. The connector portions 70 may be the same as one another in other examples. The tab 68 is hence removed from its original position and the article is modified to indicate that it has been previously filled.

Figure 11:
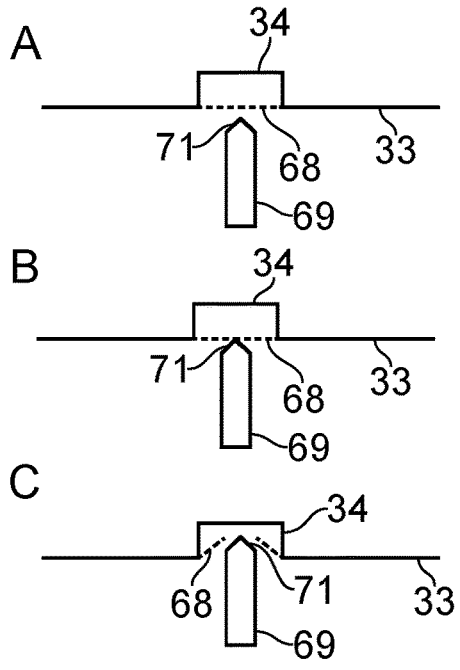
FIGS. 11A to 11C show schematic and simplified representations of some components and parts of a seventh example refilling device and article according to embodiments of the present disclosure.

FIG. 11 shows a series of schematic representations, 11A-11C of a second example of a modifiable tab fill status indicator, in its two indicator states. FIG. 11A shows part of the housing 33 of an article, with a recess 34 provided as in the FIG. 11 example. In this example, however, the tab 68 is configured as a film or membrane stretched taught or near-taught across the mouth of the cavity 34. The film is designed to be punctured or ruptured under the application of pressure, which is applied by the ram 68. It may be formed from a metal foil, or a plastic film, or a plant-based material formed into a membrane, for example. The ram 69 may be provided with a shaped end 71, such as pointed end, in order to facilitate its puncturing effect. FIG. 11B shows the ram 69 in a partially advanced position at which it has made contact with the tab 68, which is detected by the dock's controller as described above. The taught arrangement of the film tab 68 provides resistance to the ram's movement so can be detected. FIG. 11C shows the ram 69 in its fully advanced position, after its forward motion has caused it to press against the tab 68 and to break through the film. The tab 68 is hence removed from its original position and will not offer any resistance to the ram on future occasions. Hence the article is modified to indicate that it has been previously filled.

The fill status indicator tab can be provided on any part of the outer surface of the article, perhaps in a position to align with a convenient location of the ram within the dock. However, it may be located on an end face of the article which is coupled to the device of the aerosol provision system, so as to be hidden when the system is assembled for use.

Other configurations for providing a modifiable aspect to the article which can be "read" or accessed by the controller to determine a fill status may alternatively be used in place of fill status data stored in memory or a physical tab.

We now turn to the proposed second example of a pre-treatment for an article which can be implemented in refill dock. As noted above, the second example is a pre-wetting process which is carried out in the presence of fluid in the article, and therefore during or after filling of the storage area. When an article is filled for the first time, or refilled after a period of non-use, the atomizer will be dry, having yet absorbed fluid from the newly filled storage area. If the user attempts to use the aerosol provision system promptly after filling, the atomizer may still be dry or relatively dry, which can give a poor aerosol delivery experience and may damage the atomizer. To address this, it is proposed to apply a pre-treatment in form of a pre-wetting process to an article after it has been filled or refilled. The pre-wetting process promotes absorption of fluid by the atomizer so that it is primed for use on removal from the refilling dock.

Figure 12:
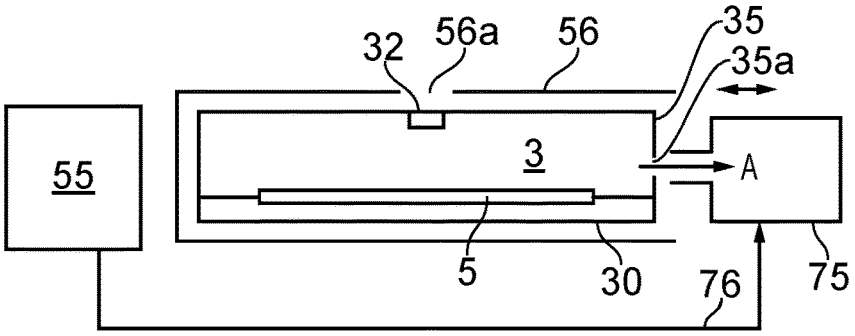
FIG. 12 shows a schematic and simplified representation of some components and parts of a eighth example refilling device and article according to embodiments of the present disclosure.

FIG. 12 shows a highly schematic and simplified representation of some of the components and parts of an example refilling dock such as that shown in FIGS. 2 and 3 but configured for pre-wetting, and for which like reference numerals are used where appropriate. Only those parts of the dock which are most relevant to the pre-wetting process are shown, for the sake of simplicity, but in this example the pre-heating process may also be included. As before an article interface 56 is provided, into which an article 30 is inserted or received. Although not shown in previous Figures, the article 30 has an outlet 35*a* at a mouthpiece end 35. The dock further comprises a pump 75 for pumping air. The pump 75 is located with respect to the article interface 56 such that it can be coupled to the mouthpiece outlet 35*a*. This might be by movement of the pump 75 into and out of engagement with the mouthpiece outlet 35*a*, as suggested by the double-headed arrow in FIG. 12, or may be achieved by the mouthpiece outlet 35 being brought into alignment with the pump 75 as part of its location and alignment within the dock for refilling. After the controller 55 has completed execution of the filling action to fill the storage area 3 of the article 30 with fluid, it then executes a pre-wetting process. The pump 75 is engaged with the mouthpiece outlet 35*a* if it is not already, and the pump is operated by the controller 55 via a control line 76 in order to remove air A from the interior of the article. This reduces pressure inside the article, including within the pores of the porous structure of the atomizer, to give a negative pressure within the atomizer compared to the storage area 3 which is filled with fluid. This pressure differential causes fluid to be drawn or pulled into the porous structure of the atomizer more rapidly than would occur in the absence of such a pressure imbalance, so the atomizer becomes wetted and ready for use more quickly. It is therefore primed for vapor generation immediately on its extraction from the refilling dock.

While the mouthpiece outlet 35*a* of the article 30 provides a convenient port for the extraction of air from the article, the pump may be engaged with any other opening in the article housing that is in airflow communication with the atomizer. For example, inlets to the airflow path through the article may be used.

Figure 13:
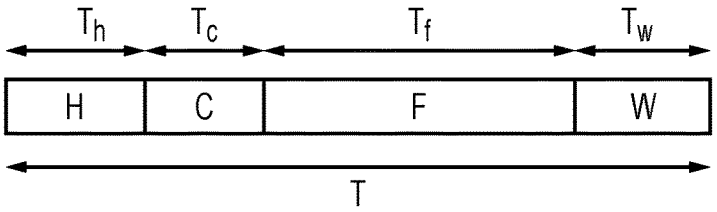
FIG. 13 shows a schematic timeline of a third example operating period of a refilling device according to embodiments of the present disclosure.

FIG. 13 shows a schematic representation of a third example operating period or timeline for a refilling dock or refilling device, in this case configured to provide a pre-heating treatment and a pre-wetting treatment to an article. In common with the embodiments described earlier, a pre-heating process is carried out for a heating period H having a duration Th. This is followed by an optional cooling period C having a duration Tc, and the filling action F having a duration Tf. Then, on completion of the filling action F, the controller executes a pre-wetting treatment by operating the pump for a wetting period W having a duration Tw. The total duration T of these operations, Th+Tc+Tf+Tw, or optionally Th+Tf+Tw is again preferably 2 minutes or less, for user convenience. The duration Tw of the wetting period may be in the range of 2 to 5 seconds, for example although shorter or longer times may be used such as in the range of 1 to 10 seconds, perhaps with reference to the power of the pump, the size of the air outlet, the viscosity of the fluid and/or the pore size of the atomizer.

Figure 14:
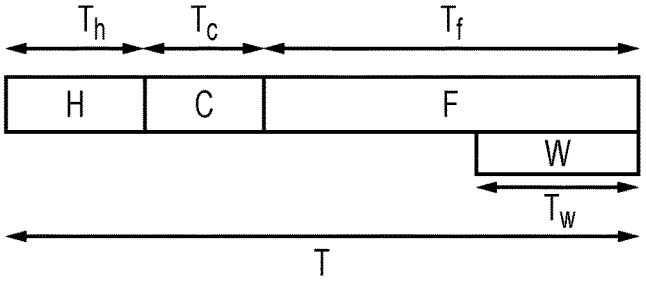
FIG. 14 shows a schematic timeline of a fourth example operating period of a refilling device according to embodiments of the present disclosure.

FIG. 14 shows a schematic representation of a fourth example operating period or timeline for a refilling dock or refilling device configured for both a pre-heating treatment and a pre-wetting treatment. Fluid flow from the storage area into the atomizer can take place with an incompletely filled storage area, so there is no need to wait for completion of the filling action before commencing the wetting period. Hence, the overall operation time can be reduced if the wetting period runs concurrently with the filing action. Therefore, after completion of the heating period H and the optional cooling period C, the filling action F begins, and some time after its commencement, in order to provide some fluid into the storage area, the wetting period W is begun. Its duration Tw is less than the duration Tf of the filling action, so the two processes can finish at the same time, as shown in FIG. 14, or the wetting period W may finish before the filling action F, or after although this gives less time saving to the overall operating period T. In other words, the wetting period may occur wholly or partly within the filling action.

It is also proposed that the pre-wetting treatment can usefully be applied without the pre-heating treatment, in order to load the atomizer with fluid ready for aerosol production. In the context of articles with a monolithic atomizer comprising a porous electrically conductive heating member as considered thus far (metallic or ceramic, for example), this may be useful where the atomizer comprises a material that is not subject to significant unwanted deterioration while standing in a dry and unused state, for example, or where the provision of pre-heating capability is considered to add too much time to the refilling cycle or unwanted complication to the dock configuration. Additionally, however, pre-wetting is useful for other types of atomizer which may not require a pre-heating treatment, and are configured otherwise. In particular, an atomizer may be formed out separate elements for wicking and for heating/vaporizing. The atomizer may comprise a porous material transfer component or wicking member for absorbing fluid from the storage area, and an adjacent heater or heating element formed from an electrically conductive material such as metal or ceramic. The wicking member may comprise an elongate fibrous member formed from fibers of, for example, cotton, ceramic, glass, or synthetic material, bundled, twisted or woven together, or from a solid material with pores or a porous structure, such as a ceramic material. Other shapes for the wicking member are also possible. The heater may be formed as a shaped metallic wire heating element, formed as a coil, a line, or a serpentine or other curved shape, or have a flat formed stamped from metal, or may be printed onto a substrate or printed into the heater. In general the heater is arranged adjacent to the wicking member, often in contact with it, so that heat energy from the heater is transferred to fluid in the wicking member. The heater may be external to the wicking member or embedded or otherwise disposed inside the wicking member. The heater may be configured with electrical connections for the supply of current so as to operate by resistive (Ohmic or Joule) heating, or may be configured as a susceptor for inductive heating.

Figure 15:
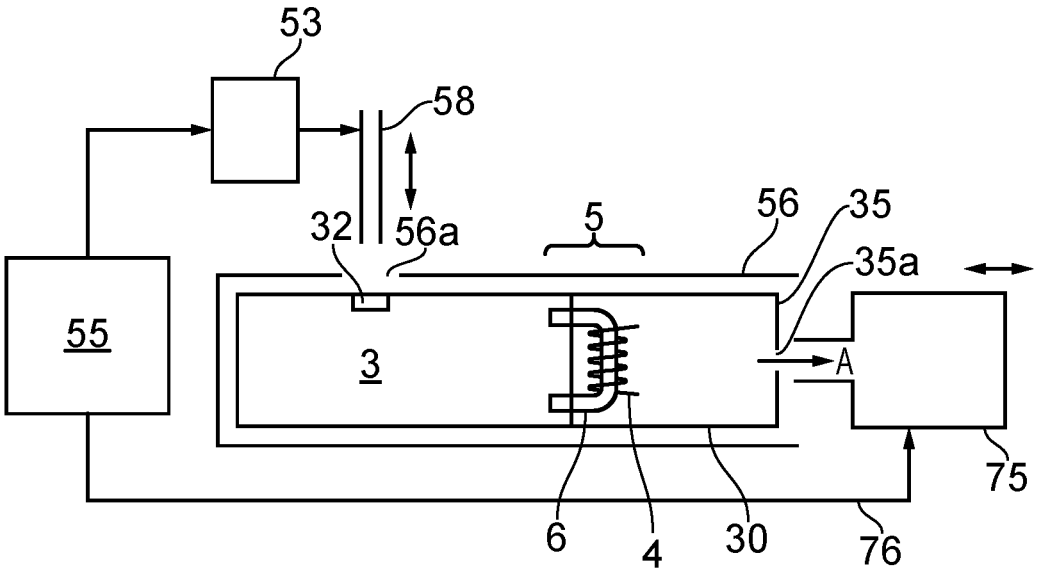
FIG. 15 shows a schematic and simplified representation of some components and parts of a ninth example refilling device and article according to embodiments of the present disclosure.

FIG. 15 shows a highly schematic and simplified representation of some of the components and parts of a further example refilling dock such as that shown in FIGS. 2 and 12, and for which like reference numerals are used where appropriate. The dock is configured to provide a pre-wetting process. Only those parts of the dock which are most relevant to the pre-wetting process are shown, for the sake of simplicity. As previously, an article interface 56 is provided, into which an article 30 is inserted or received. In this example, the article 30 has an elongate shape with a inlet orifice 32 on its side, and is inserted lengthwise and horizontally into the article interface 56 of the dock so that the inlet orifice 32 faces upwards, while a mouthpiece outlet 35*a* at the mouthpiece end 35 of the article lies at one side. An opening 56*a* in the upper wall of the article interface 56 allows a fluid conduit 58 to enter the article interface 56 and engage with the inlet orifice 32 for the purpose of delivering fluid from a reservoir (not shown) into a storage area 3 in the article 30. The fluid conduit is part of a fluid transfer mechanism 53 which is controlled by a controller 55 of the dock to perform a filling action for the delivery of a required amount fluid from the reservoir to the storage area 3 when the fluid conduit 58 is engaged with the inlet orifice 32. The engagement may be achieved by movement of the fluid conduit 58 towards the article 3, and/or vice versa.

The article 30 has an atomizer 5 in the form of a porous wicking member 6 with an elongate shape, the ends of which extend into the storage area 3 to absorb fluid, plus a heating element 4 in the form of a wire coil wrapped around the wicking member. Electrical connection of the heating element 4 is omitted for clarity.

The dock further comprises a controller 55, which, as explained with reference to FIG. 3, is configured to operate the fluid transfer mechanism 53 to execute a filling action in which fluid is moved from the reservoir via the fluid conduit 58 and delivered into the storage area 3. The dock further comprises a pump 75 arranged for engagement with the mouthpiece outlet 35*a* of the article 30, operable by the controller 55 via a control line 76 to execute a pre-wetting process by drawing air A out from the interior of the article, as described with reference to FIG. 12. The pump 75 may alternatively engage with a different external opening in the article 30 for the purpose of removing air. The pre-wetting promotes fluid flow into the wicking member 6, after which the article 30 is filled and primed, and can be removed from the article interface 56 and is ready for use.

Figure 16:
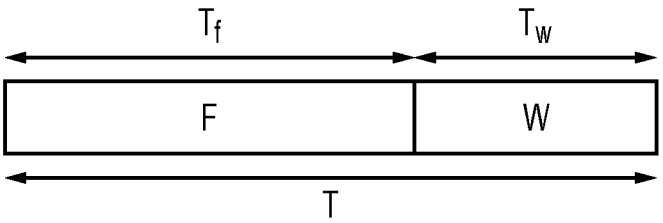
FIG. 16 shows a schematic timeline of a fifth example operating period of a refilling device according to embodiments of the present disclosure.

FIG. 16 shows a schematic representation of a fourth example operating period or timeline for a refilling dock or refilling device, in this case configured to provide a pre-wetting treatment to an article. As discussed with regard to FIG. 13, the pre-wetting may be performed after the storage area has been filled. Accordingly, the operating period comprise a filling action F of duration Tf, followed by a pre-wetting process in which a wetting period W in which air is removed from the article has a duration of Tw. The wetting period may commence immediately that the filling action ends, or there may be an intervening period (not shown) in which the dock performs some other function. The total operating period has a duration T, which as before may have a duration of not more than 2 minutes, although longer and shorter times may be used.

Figure 17:
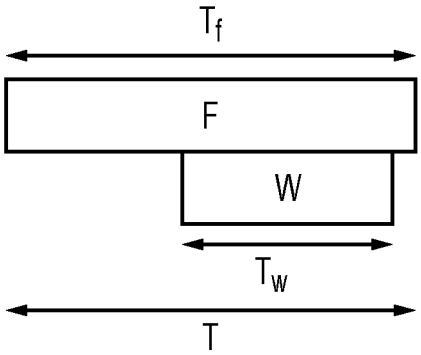
FIG. 17 shows a schematic timeline of a sixth example operating period of a refilling device according to embodiments of the present disclosure.

FIG. 17 shows a schematic representation of a fourth example operating period or timeline for a refilling dock or refilling device, in this case configured to provide a pre-wetting treatment to an article. As discussed with regard to FIG. 13, the wetting period may be performed in an overlapping time with the filling action, once some fluid is available in the storage area. Accordingly, in this example the operating period comprises the filling action F of duration Tf, and the wetting period W starting after the filling action and of duration Tw shorter than Tf, and running concurrently with the filling action. The wetting period ceases before the end of the filling action, which may be convenient for decoupling the pump from the article before the actions required to disengage the fluid conduit from the article. However, as before, the wetting period may finish at the same time as or later than the end of the filling action.

An additional example will now be described, which is a version of the first example since it utilizes a pre-heating period for atomizers having the form of a porous electrically conductive member which may degrade over time and benefit from refurbishment before a first use for vaporing fluid from the storage area. In this example, however, the pre-heating is implemented in the aerosol provision system itself, rather than in a refilling dock. This is enabled since electrically operated aerosol provision systems comprise a power source (battery) for supplying electrical power to the atomizer during vapor generation that can additionally be used to power a pre-heating treatment. The aerosol provision system therefore comprises a refillable storage area for fluid, an atomizer having porosity for absorbing fluid from the storage area and comprising an electrically conductive heating member for vaporing the absorbed fluid (as described above for the first example), and a battery for supplying electrical power to cause heating of the heating member. Additionally, the aerosol provision system comprises a controller, which is typically present in such systems for controlling the supply of electrical power to the heating member for vapor generation, and in this example is configured to operate the battery to supply electrical power to produce current flow in the heating member during a heating period to cause heating of the heating member—this is the pre-heating period. In general, the controller can be configured to implement the pre-heating in the same way as the controller of the refilling dock described above, but will be not be configured to control any filling of the storage area since this is relevant to a refilling dock only. Hence, the heating period may have a duration such as described above, for example ten seconds or less.

It is necessary to distinguish between operation of the heating member for pre-heating and more general operation of the heating member for vapor generation. The pre-heating need only be performed when the atomizer is new and unused (and therefore potentially degraded or deteriorated), and should not otherwise be implemented since it may interfere with or be confused with vapor generation and produce a poor experience for the user. The aerosol provision system may be provided initially with an empty but refillable storage area, and the atomizer will be completely dry before the storage area is filled, so that the pre-heating may be carried out before or shortly after the user has filled the storage area for the first time and made the aerosol provision system ready for vapor generation. In other cases, the aerosol provision system may be provided initially with a filled storage area (which may be refillable or single use) and the atomizer may be dry, partly dry, or wet, and pre-heating is carried out before a first use of the atomizer for vapor generation. A different amount of power (less or more) may be supplied to the heating member for pre-heating than for vapor generation, or a single power level may be used for both types of heating.

In order to show when pre-heating is appropriate, namely, before the first use of the atomizer for vapor generation, when the atomizer is new and possibly degraded, the aerosol provision system additionally includes a use status indicator that indicates the use status of the heating member as being either unused (new) or used (already used for vapor generation, or at least ready to be used for vapor generation). The controller is configured to interrogate or sense the use status indicator in order to determine from it whether the heating member is used or unused. If the heating member is determined to be unused, the controller operates the battery in order to apply the heating period of the pre-heating treatment. If the heating member is determined to be used, the controller skips the pre-heating treatment and operates the battery only to heat the heating member for vapor generation. Hence, the use status indicator performs a similar function as the fill status indicator described with respect to the first example, but in this example the term "use" may be considered more relevant than "fill", since the storage area may or may not be refillable and the aerosol provision system may be provided with the storage area empty or pre-filled.

Various forms of fill status indictor are envisaged, and may be similar to the forms of use status indicator already described. The type of use status indicator chosen may depend on the overall format of the aerosol provision system. As described above with regard to FIG. 1, an aerosol provision system may comprise two separably connectable components, between which the parts of the system are distributed. A typical configuration is an article comprising the fluid storage area and the atomizer, and a device component comprising the battery and the controller, where the device component is typically re-usable with a succession of articles, and the article may be disposable or replaceable, or simply removal to facilitate refilling of the storage area or maintenance/replacement of the atomizer. In other designs, an aerosol provision system may be unitary, with the parts mentioned above held within a single unitary housing.

A first example of a use status indicator, which is suitable for both unitary and two-component systems, is a memory in which data representing or indicating the use status of the heating member is stored. The data may comprise a 0 or a 1, or other two-state indicator or flag. When the heating member is unused (for example, the aerosol provision system is new, or the article is new in the case of two-component systems), the use status data reflects this, for example having been set appropriately during manufacture of the system. The controller reads the data, for example prompted by a powering up the system, or a connecting of the components, and if the use status data shows an unused status, the controller determines that the heating member is used, and carries out a pre-heating by causing heating of the heating member for the heating period. In order to avoid further unnecessary pre-heating, the controller changes the use status data to show a used status for the heating member. On subsequent powering up or connection of the components, the controller will determine from the use status indicator that the heating member is used, and will not apply the pre-heating treatment.

A second example of a use status indicator, primarily suitable for two-component systems, is a use status indicator tab comprised in the article, and similar to the tabs described above. The article is provided when new with the tab in a first configuration or position, from which the tab can be modified into a second configuration (such as moved, distorted, damaged or removed) by physical contact. This first configuration indicates that the heating member is unused. The tab is located on the article in a location where it comes into contact with a part of the device component when the article and the device component are brought together for connection, such as a protrusion on a surface of the device component that faces towards the tab when the article and the device component are connected. Hence, when the article and the device component have been connected, the tab is modified by the act of having been connected, and now has the second configuration, indicating that the heating member has been used, or is at least ready to be used. The controller is configured to detect that the state of the tab and hence determine the use status of the heating member so that the pre-heating treatment can be performed if the use status is "unused". For example, for a new article, the controller may detect that the tab is in the first configuration as the components are being connected, such as by detecting physical resistance as the protrusion meets the tab (for example if the protrusion is spring-mounted), so that it is determined that the heating member is new. If the same article is subsequently reconnected to the device component, the tab will be already modified by contact with the protrusion, the protrusion will meet no or less resistance during connection, and a used state of the heating member will be determined.

Other examples of a use status indicator are not excluded, and may be apparent to the skilled person.

As described above, the aerosol provision system may be configured to employ resistive heating for the heating member, so that there is electrical connection between the battery and the atomizer, or the aerosol provision system may be configured to employ inductive heating for the heating member, so that an induction work coil is included in the system that receives power from the battery to heat the heating member by induction.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A refilling device for filling an article from a reservoir, comprising:

an article interface for receiving an article of an aerosol provision system, the article having a storage area for fluid and an atomizer having porosity for absorbing fluid from the storage area and comprising an electrically conductive heating member for vaporizing the absorbed fluid; and a controller configured to:

supply electrical power to produce electrical current flow in the heating member of an article received in the article interface during a heating period to cause heating of the heating member; and execute a filling action to deliver fluid to the storage area of the article after the heating period.

2. A refilling device according to claim 1, further comprising electrical contacts configured to form an electrical connection with the heating member of the article received in the article interface via further electrical contracts on the article, the controller configured to supply the electrical power to the heating member using the electrical connection to cause the heating of the heating member by resistive heating.

3. A refilling device according to claim 1, further comprising an induction work coil positioned such that the heating member of the article received in the article interface is within a magnetic field region of the induction work coil, the controller configured to supply the electrical power to the induction work coil to cause the heating of the heating member by inductive heating.

4. A refilling device according to claim 1, wherein the heating period has a duration of ten seconds or less.

5. A refilling device according to claim 1, wherein the heating period and the filling action have a total duration of 2 minutes or less.

6. A refilling device according to claim 1, wherein the controller is configured to commence execution of the filling action immediately on expiry of the heating period.

7. A refilling device according to claim 1, wherein the controller is configured to implement a cooling period between expiry of the heating period and commencing execution of the filling action.

8. A refilling device according to claim 7, wherein the heating period, the cooling period and the filling action have a total duration of 2 minutes or less.

9. A refilling device according to claim 1, further comprising an air pump for removing air from inside an article received in the article interface, and the controller further configured, during the filling action or after completion of the filling action, to operate the air pump to reduce air pressure inside the article for a wetting period to promote flow of fluid from the storage area into the atomizer.

10. A refilling device according to claim 9, wherein the wetting period has a duration in the range of 2 to 5 seconds.

11. A refilling device according to claim 9, wherein the heating period, the refilling action and the wetting period have a total duration of 2 minutes or less.

12. A refilling device according to claim 1, wherein the atomizer comprises an electrical resistance heating element having a porous structure for absorbing fluid from the storage area.

13. A refilling device according to claim 12, wherein the atomizer comprises metallic fibers.

14. A refilling device according to claim 12, wherein the atomizer is formed from stainless steel.

15. A refilling device according to claim 12, wherein the atomizer has a planar shape.

16. A refilling device according to claim 1, wherein the controller is further configured to determine, from a fill status indicator comprised in the article, if the article received in the article interface has or has not previously been filled, and to supply electrical power for the heating period only when it is determined that the article has not previously been filled.

17. A refilling device according to claim 16, wherein the controller is configured to determine if the article has or has not previously been filled by reading fill status data stored in memory comprised in the article.

18. A refilling device according to claim 16, wherein the controller is configured to determine that the article has not previously been filled by detecting the presence of a fill status indicator tab comprised in a housing of the article.

19. A refilling device according to claim 16, wherein the controller is further configured, when it is determined that the article has not previously been filled, to modify the article received in the article interface to record that it has now been filled.

20. A refilling device according to claim 19, wherein the controller is configured to modify the article by changing fill status data stored in memory comprised in the article.

21. A refilling device according to claim 19, wherein the controller is configured to modify the article by altering a fill status indicator tab on a housing of the article.

* * * * *